US011674670B2

(12) United States Patent
Chen et al.

(10) Patent No.: US 11,674,670 B2
(45) Date of Patent: Jun. 13, 2023

(54) DOWNLIGHT APPARATUS

(71) Applicant: XIAMEN ECO LIGHTING CO. LTD.

(72) Inventors: Jinfu Chen, Xiamen (CN); Lina Bai, Xiamen (CN); Ying Chen, Xiamen (CN); Zhenyu Tang, Xiamen (CN); Shuxing Gao, Xiamen (CN); Yongzhe Dong, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 17/477,120

(22) Filed: Sep. 16, 2021

(65) Prior Publication Data

US 2022/0082235 A1 Mar. 17, 2022

(30) Foreign Application Priority Data

Sep. 16, 2020 (CN) ..... 202022031847.X
Sep. 16, 2020 (CN) ..... 202022032149.1
Sep. 16, 2020 (CN) ..... 202022033977.7

(51) Int. Cl.
*F21V 21/04* (2006.01)
*F21S 8/02* (2006.01)
(Continued)

(52) U.S. Cl.
CPC ..... *F21V 21/04* (2013.01); *F21S 8/026* (2013.01); *F21V 21/15* (2013.01); *F21V 21/38* (2013.01);
(Continued)

(58) Field of Classification Search
None
See application file for complete search history.

(56) References Cited

U.S. PATENT DOCUMENTS 7,192,160 B2 * 3/2007 Reiff, Jr. ..... F21L 2/00 362/228
2010/0296301 A1 * 11/2010 Xhunga ..... F21V 29/76 362/404
(Continued)

FOREIGN PATENT DOCUMENTS

CN 108240580 A * 7/2018
CN 108730843 A * 11/2018 ..... F21S 8/00
(Continued)

*Primary Examiner* — Alan B Cariaso
(74) *Attorney, Agent, or Firm* — Chun-Ming Shih; HDLS IPR Services

(57) ABSTRACT

A downlight apparatus includes a downlight housing, a drawstring module and a light module. The downlight housing has a surface rim and a downlight holder. The surface rim defines a rim opening. The surface rim conceals an installation cavity. The holder defines a holder space connected to the rim opening. The downlight housing is attached in the installation cavity with a fixing unit. The drawstring module is used for collecting a pullable wire. The pullable wire is electrically connected to a power source. The light module has a light source and a light housing. The light housing is connected to a bottom end of the pullable wire for electrically connecting the power source to the light source. The light module is pulled out from the holder space to an adjustable distance from the rim opening with the pullable wire connecting the light module to the downlight housing.

17 Claims, 12 Drawing Sheets

(51) Int. Cl.

| | |
|---|---|
| ***F21V 23/04*** | (2006.01) |
| ***F21V 23/00*** | (2015.01) |
| ***F21V 21/38*** | (2006.01) |
| ***F21V 21/15*** | (2006.01) |
| ***F21Y 113/10*** | (2016.01) |
| ***F21Y 115/10*** | (2016.01) |

(52) U.S. Cl.
CPC ..... *F21V 23/003* (2013.01); *F21V 23/008* (2013.01); *F21V 23/009* (2013.01); *F21V 23/04* (2013.01); *F21Y 2113/10* (2016.08); *F21Y 2115/10* (2016.08)

(56) References Cited

U.S. PATENT DOCUMENTS

| | | | | |
|---|---|---|---|---|
| 2015/0233537 | A1* | 8/2015 | Athalye | H05B 45/3725 362/147 |
| 2016/0040839 | A1* | 2/2016 | Driscoll | F21V 29/767 362/294 |
| 2017/0167675 | A1* | 6/2017 | Katona | F21V 23/0464 |
| 2018/0206305 | A1* | 7/2018 | Van Winkle | F21S 8/026 |
| 2019/0195478 | A1* | 6/2019 | Hayrapetian | F21V 21/38 |

FOREIGN PATENT DOCUMENTS

| | | | |
|---|---|---|---|
| CN | 111076122 | A * | 4/2020 |
| DE | 202016101262 | U1 * | 7/2017 |
| KR | 200432753 | Y1 * | 12/2006 |

* cited by examiner

DOWNLIGHT APPARATUS

FIELD

The present invention is related to a downlight apparatus, and more particularly related to a downlight apparatus with a pullable light module.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

Downlight devices are widely used in various places. Many places are pre-installed with junction boxes or cavities in ceiling for installing downlight devices.

Most downlight devices are therefore placed on a high position in an environment. If there is a novel way to use the downlight device to change the light source position, it is convenient for users to adjust light pattern to meet their needs.

Therefore, it is beneficial to provide a flexible design for a downlight device to be more convenient. Downlight devices are widely used in various places. Many places are pre-installed with junction boxes or cavities in ceiling for installing downlight devices.

Most downlight devices are therefore placed on a high position in an environment. If there is a novel way to use the downlight device to change the light source position, it is convenient for users to adjust light pattern to meet their needs.

Therefore, it is beneficial to provide a flexible design for a downlight device to be more convenient. Downlight devices are widely used in various places. Many places are pre-installed with junction boxes or cavities in ceiling for installing downlight devices.

Most downlight devices are therefore placed on a high position in an environment. If there is a novel way to use the downlight device to change the light source position, it is convenient for users to adjust light pattern to meet their needs.

Therefore, it is beneficial to provide a flexible design for a downlight device to be more convenient. Downlight devices are widely used in various places. Many places are pre-installed with junction boxes or cavities in ceiling for installing downlight devices.

Most downlight devices are therefore placed on a high position in an environment. If there is a novel way to use the downlight device to change the light source position, it is convenient for users to adjust light pattern to meet their needs.

Therefore, it is beneficial to provide a flexible design for a downlight device to be more convenient.

SUMMARY

In some embodiments, a downlight apparatus includes a downlight housing, a drawstring module and a light module.

The downlight housing has a surface rim and a downlight holder.

The surface rim defines a rim opening.

The surface rim conceals an installation cavity.

The holder defines a holder space connected to the rim opening.

The downlight housing is attached in the installation cavity with a fixing unit.

The drawstring module is used for collecting a pullable wire.

The pullable wire is electrically connected to a power source.

The light module has a light source and a light housing.

The light housing is connected to a bottom end of the pullable wire for electrically connecting the power source to the light source.

The light module is pulled out from the holder space to an adjustable distance from the rim opening with the pullable wire connecting the light module to the downlight housing.

In some embodiments, the fixing unit includes a pair of elastic units for elastically changing a span diameter to fix the downlight housing to the installation cavity.

In some embodiments, the downlight apparatus may also include a driver box with a driver circuit for converting an external power to the power source supplied to the pullable wire.

In some embodiments, the drawstring module has a string box and an wiring bracket.

The wiring bracket has a rotation wheel for collecting the pullable wire.

In some embodiments, the wiring bracket has an elastic module for providing an elastic force for pulling the pullable wire back to the rotation wheel.

The wiring bracket has a stop unit for keep the pullable wire to stay when no external pulling force is applied to the pullable wire.

In some embodiments, the wiring bracket comprises a tilt sliding groove for guiding detaching the pullable wire from the stop unit temporarily.

In some embodiments, the stop unit has an elastic module with a bent part for guiding the pullable wire to detach from the stop unit when an external pulling force is applied to the pullable wire and guiding the pullable wire to engage the stop unit when no external pulling force is applied to the pullable wire.

In some embodiments, the drawstring module has a wire fastener for fixing a wire part of the pullable wire nonmovable with respect to the string box.

In some embodiments, a wire connector is used for electrically connecting a power wire to the pullable wire.

In some embodiments, the light module has a light module connector connecting to the pullable wire.

The light module connector is detachable from the pullable wire to replace another light module to attach to the pullwire.

In some embodiments, the light module has a rotation bracket for changing a light direction of the light source.

In some embodiments, the light module has an manual switch to turn on or turn off the light source.

In some embodiments, the light module has a manual switch for adjusting a light parameter of the light source.

In some embodiments, the light source has multiple types of LED modules to mix a required color temperature.

The manual switch indicates the required color temperature.

In some embodiments, the light module has a sensor for detecting an ambient light parameter around a current position of the light module.

The light source is automatically adjusted according to the ambient light parameter.

In some embodiments, the drawstring module has a motor for extending or collecting the pullable wire to change a relative distance of the light module to the downlight housing.

In some embodiments, the light module has a detector for sensing a user operation to actuate the motor to change the relative distance of the light module and the downlight housing.

In some embodiments, the detector detects a user gesture to actuate the motor to move the pullable string.

In some embodiments, the light source has a lateral light source and a bottom light source to be controlled separately.

In some embodiments, the light source has a light source electrode to be detachable from the light housing to be replaced with another light source.

DETAILED DESCRIPTION

Figure 20:
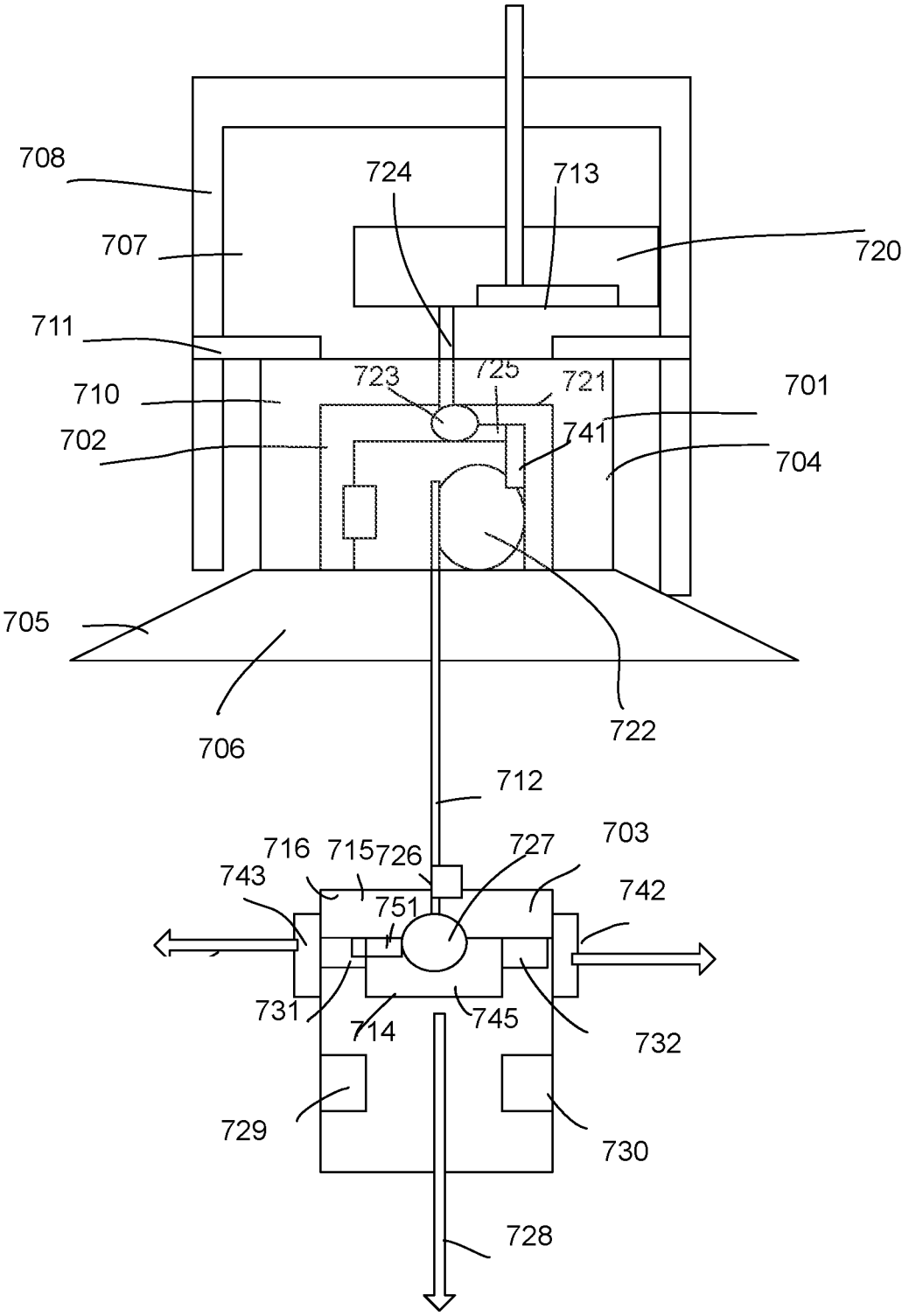
FIG. 20 shows another downlight apparatus.

In FIG. 20, a downlight apparatus includes a downlight housing 701, a drawstring module 702 and a light module 703.

The downlight housing 701 has a surface rim 705 and a downlight holder 704.

The surface rim 705 defines a rim opening 706.

The surface rim 705 conceals an installation cavity 707 which may be defined by a junction box 708 or a ceiling cavity.

The downlight holder 704 defines a holder space 710 connected to the rim opening.

The downlight housing is attached in the installation cavity 707 with a fixing unit 711.

The drawstring module 702 is used for collecting a pullable wire 712.

The pullable wire 712 is electrically connected to a power source, e.g. a driving current generated by a driver circuit 713 or an external power like 110V AC power.

The light module 703 has a light source 714 and a light housing 715.

The light housing 715 is connected to a bottom end 716 of the pullable wire 712 for electrically connecting the power source to the light source 714. The power source refers to an electricity source, which is invisible. However, persons of ordinary skilled in the art would understand the power source with above description.

The light module 703 is pulled out from the holder space 710 to an adjustable distance from the rim opening 706 with the pullable wire 712 connecting the light module 703 to the downlight housing 701.

In some embodiments, the fixing unit includes a pair of elastic units for elastically changing a span diameter to fix the downlight housing to the installation cavity.

Figure 1:
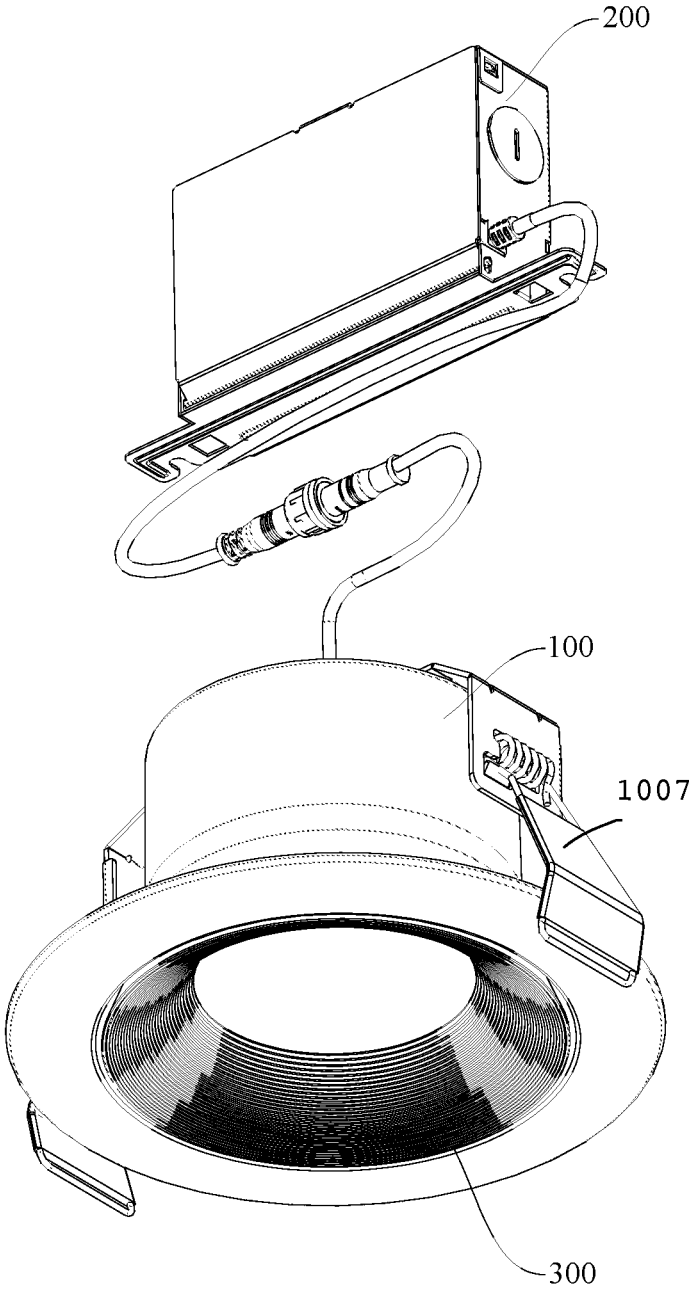
FIG. 1 illustrates a downlight apparatus embodiment.

FIG. 1 shows a pair of elastic units 1007 to attach to a junction box or a ceiling cavity for installing a downlight device.

In FIG. 20, the downlight apparatus may also include a driver box 720 with a driver circuit 713 for converting an external power to the power source supplied to the pullable wire 712.

In some embodiments, the drawstring module 702 has a string box 721 and an wiring bracket 722.

The wiring bracket 722 has a rotation wheel for collecting the pullable wire 712.

Figure 4:
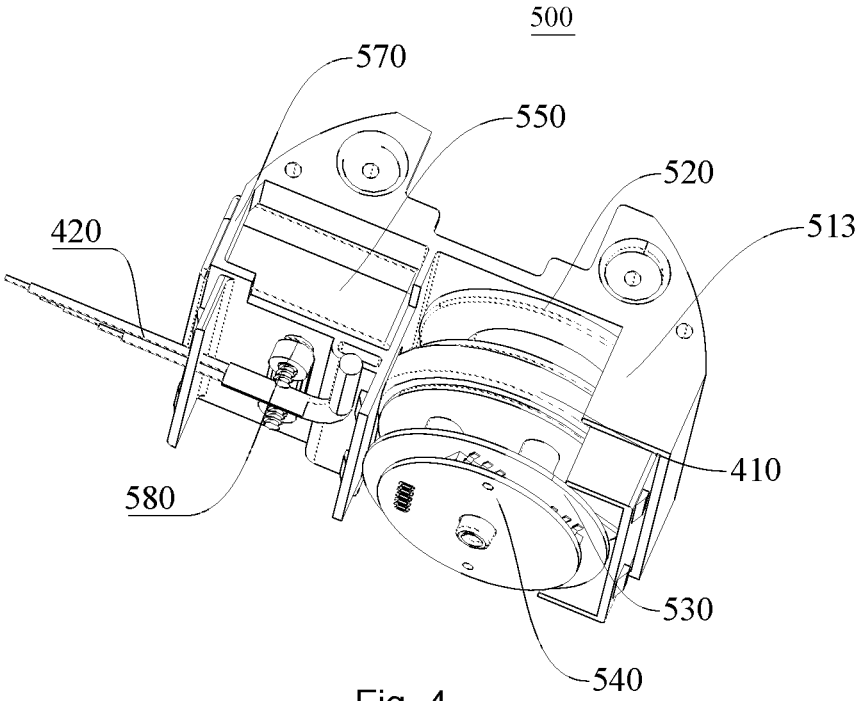
FIG. 4 illustrates an inner structure of a drawstring module.
Figure 5:
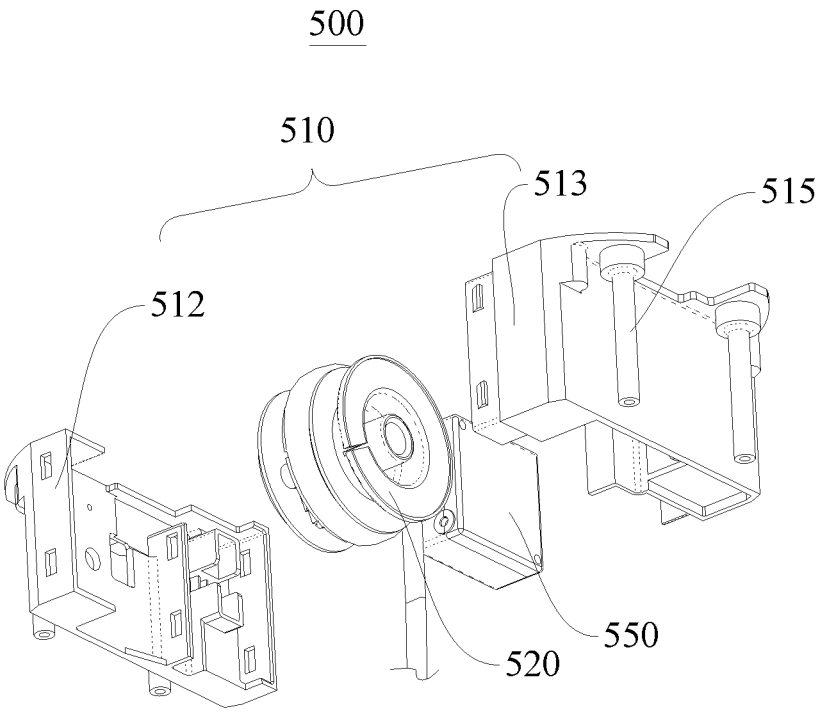
FIG. 5 illustrates an exploded view of the example in FIG. 4.

FIG. 4, FIG. 5, FIG. 6, FIG. 7, FIG. 8, FIG. 11 and other drawings show a detailed example of such wiring bracket. For example, the rotation wheel 520 in FIG. 5 is used for collecting the pullable wire.

In some embodiments, the wiring bracket has an elastic module for providing an elastic force for pulling the pullable wire back to the rotation wheel.

Figure 9:
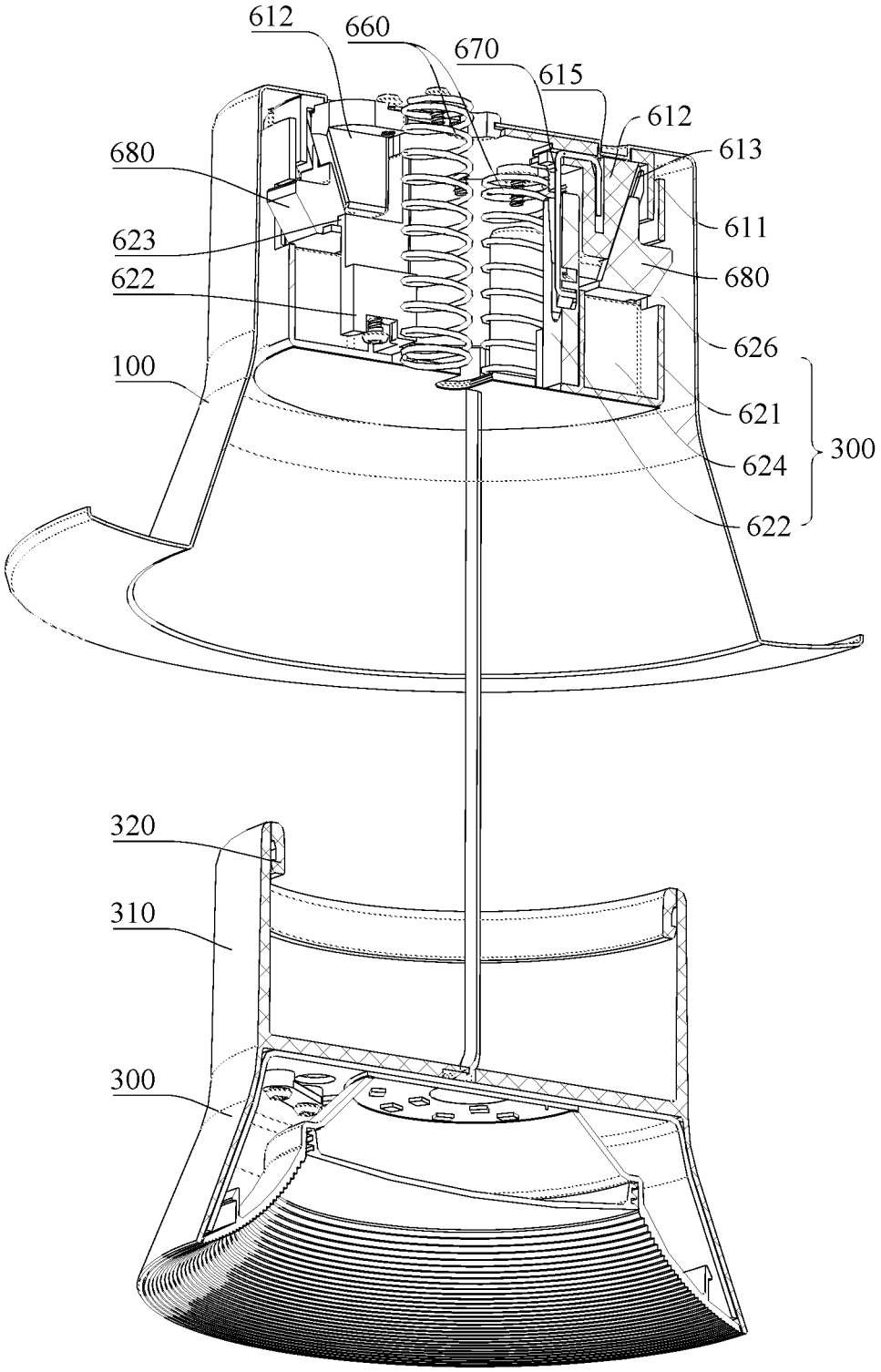
FIG. 9 illustrates a cross-sectional view of the example in FIG. 1.

For example, FIG. 9 shows an elastic module 660 made of springs for providing elastic force to pull back the pullable wire.

The wiring bracket has a stop unit for keep the pullable wire to stay when no external pulling force is applied to the pullable wire.

Figure 11:
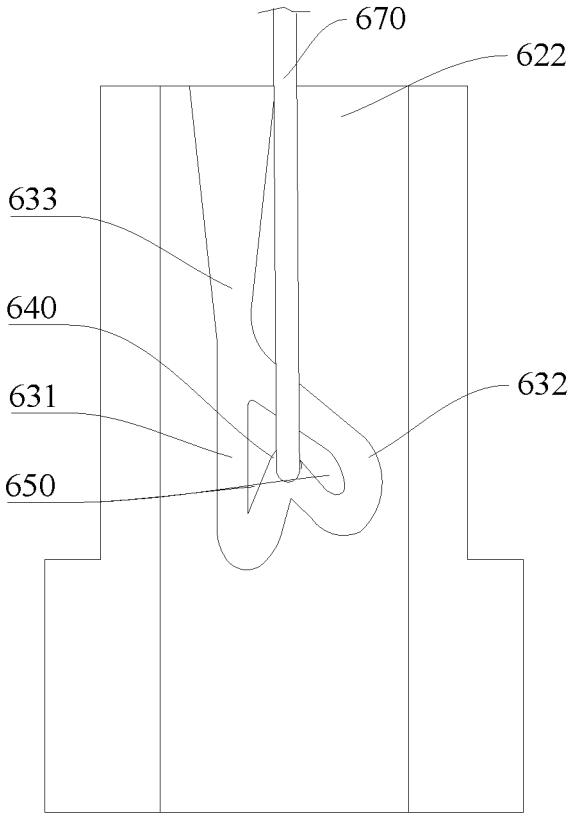
FIG. 11 illustrates a component example in a drawstring module.
Figure 15:
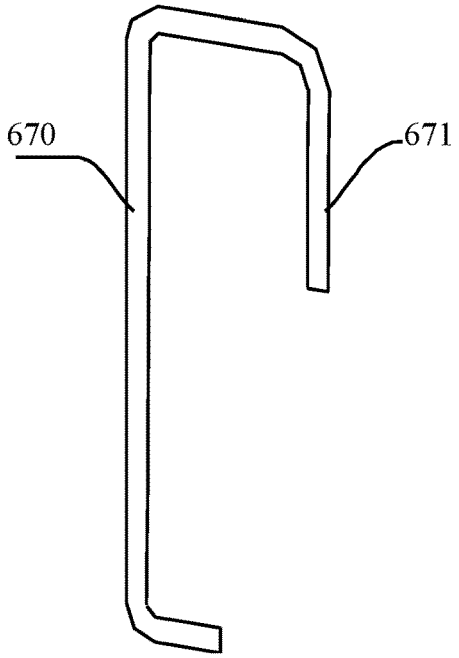
FIG. 15 illustrates a stop unit example.

FIG. 15 shows a stop unit 670 example which works together with the structure illustrated in FIG. 11.

In some embodiments, the wiring bracket comprises a tilt sliding groove for guiding detaching the pullable wire from the stop unit temporarily.

For example, FIG. 11 shows a tilt sliding groove 631, 632 for the pullable wire to detach from the stop unit 670 to be moved with respect to the drawstring module.

In some embodiments, the stop unit has an elastic module with a bent part for guiding the pullable wire to detach from the stop unit when an external pulling force is applied to the pullable wire and guiding the pullable wire to engage the stop unit when no external pulling force is applied to the pullable wire.

A detail example is illustrated in following examples.

In FIG. 20, the drawstring module has a wire fastener 723 for fixing a wire part of the pullable wire 722 nonmovable with respect to the string box 721.

In some embodiments, a wire connector 725 is used for electrically connecting a power wire 724 to the pullable wire 712.

In FIG. 20, the light module has a light module connector 726 connecting to the pullable wire 712.

The light module connector 726 is detachable from the pullable wire 712 to replace another light module to attach to the pullwire 712. For example, people may replace the light module 703 as what they do for replacing a light bulb or a light tube, when the light module 703 is out of order or when they want to change another type of light module to provide a different type of light.

In some embodiments, the light module has a rotation bracket 727 for changing a light direction 728 of the light source 714. For example, there is a rotation shaft on the rotation bracket 727 to rotate the light source 714 with respect to the light module housing, which consequently change the light direction 728.

In some embodiments, the light module has an manual switch 729 to turn on or turn off the light source 714.

In some embodiments, the light module has a manual switch 730 for adjusting a light parameter of the light source.

In some embodiments, the light source has multiple types of LED modules to mix a required color temperature.

The manual switch 730 indicates the required color temperature.

In some embodiments, the light module has a sensor 731 for detecting an ambient light parameter around a current position of the light module 703. When the light module 703 is adjustable for its position with respect to the downlight housing 701, the ambient light parameter may change at different positions. It is therefore very helpful to place the sensor 731 on the light module 703.

The light source is automatically adjusted according to the ambient light parameter, e.g. different light intensity or color temperature.

In some embodiments, the drawstring module has a motor 741 for extending or collecting the pullable wire 712 to change a relative distance of the light module to the downlight housing.

In some embodiments, the light module 703 has a detector 732 for sensing a user operation to actuate the motor 741 to change the relative distance of the light module 703 and the downlight housing 701.

In some embodiments, the detector 732, which may be a camera module, detects a user gesture to actuate the motor 741 to move the pullable string 712.

In some embodiments, the light source 714 has a lateral light source 742, 743 and a bottom light source 745 to be controlled separately. In such design, the light module 703 may be controlled to emit only light downwardly or also emit light from lateral sides.

In some embodiments, the light source 714 has a light source electrode 751 to be detachable from the light housing to be replaced with another light source. For example, the light source 714 is made with an insulation cover for safety. Users may buy and replace a required light source 714 to replace the original light source by plugging the new light source to the light source electrode 751.

Please refer to FIG. 1. FIG. 1 illustrates a downlight apparatus embodiment. Please be noted that the same reference numerals in following refer to the same components among drawings. Therefore, when one reference numeral is described in some drawing, the same reference numeral may be bypassed when describing a following drawing.

In FIG. 1, the downlight apparatus includes a driver box 200, a downlight housing 100, an elastic fixing unit 1007, and a light module 300.

Figure 2:
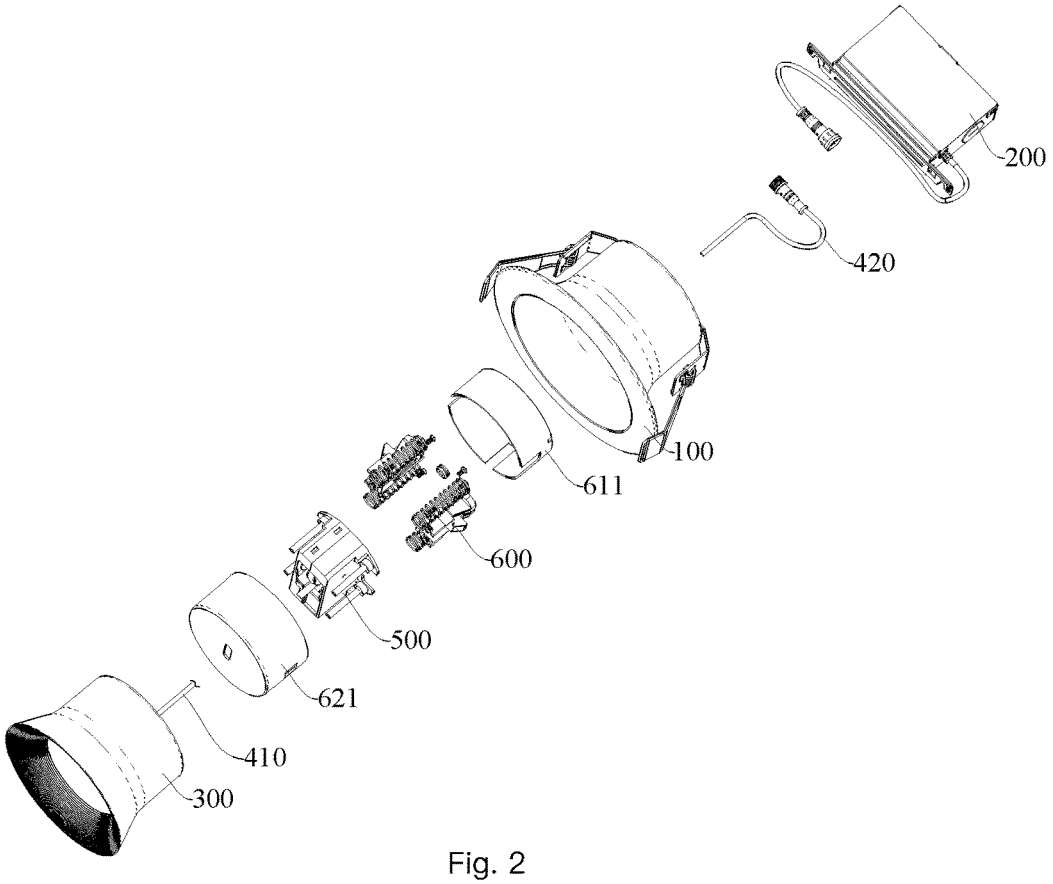
FIG. 2 illustrates an exploded view of the example in FIG. 1.

FIG. 2 illustrates an exploded view of the example in FIG. 1.

In FIG. 2, there is a power wire 420 connecting to the downlight housing 100. The drawstring module has a top cover 611, a buckle unit 600, a wiring bracket 500 and a bottom cover 621. The pullable wire 410 is used for connecting the light module 300 to the drawstring box.

Figure 3:
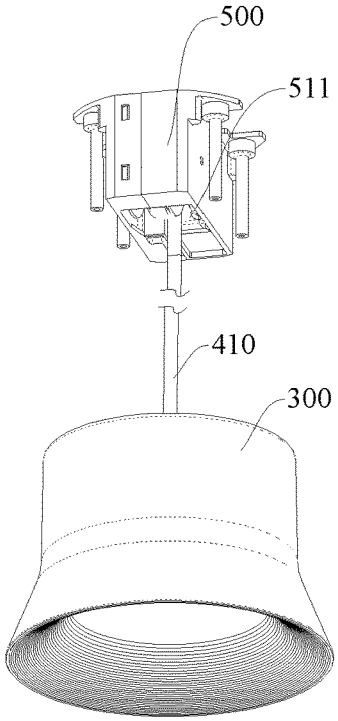
FIG. 3 illustrates a light module and a drawstring module.

FIG. 3 illustrates a light module and a drawstring module.

In FIG. 3, there is a wiring hole 511 in the wiring bracket 500 for installing the pullable wire 410 connecting to the light module 300.

FIG. 4 illustrates an inner structure of a drawstring module.

In FIG. 4, the wiring bracket 500 has a container 570 disposed with a position limiter 580 for keeping the power wire 420 non-movable. There is a rotation part 530 fixed to a fixing part 540 for placing and collecting the pullable wire 410. The fixing part 540 is attached to another housing part 513, which has a rotation wheel 520. These structures form a wiring structure 550.

FIG. 5 illustrates an exploded view of the example in FIG. 4. Please read FIG. 5 in view of FIG. 4. The rotation wheel 520 is clipped by the left part 512 and another housing part 513 to form a housing body 510. There is a plugging unit 515 for fixing the wiring bracket 500 to the drawstring module.

Figure 6:
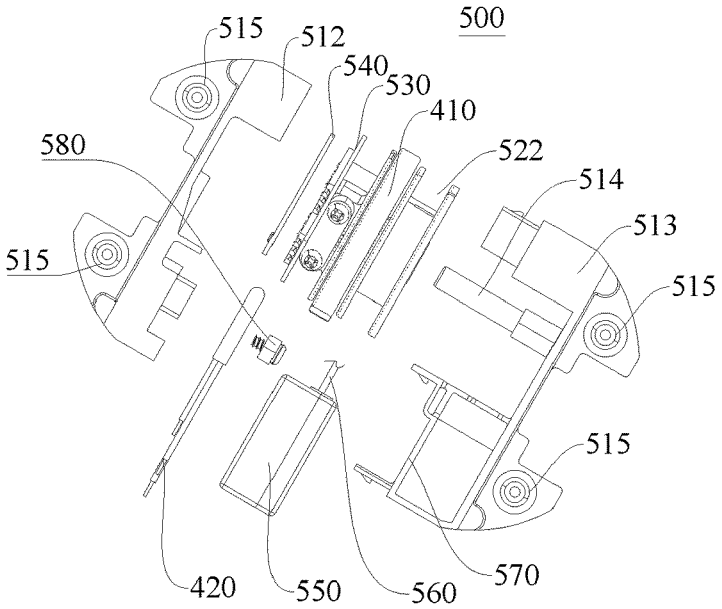
FIG. 6 illustrates another exploded view of the example in FIG. 4.

FIG. 6 illustrates another exploded view of the example in FIG. 4.

FIG. 6 shows another view, which further shows a support lever 514 and connection among multiple components mentioned above.

Figure 7:
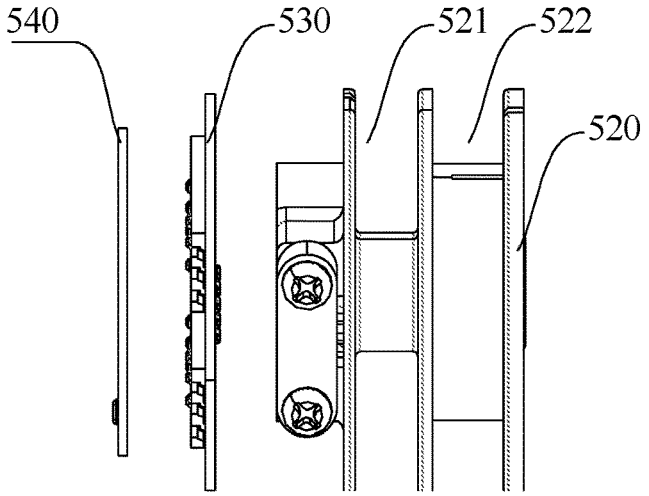
FIG. 7 illustrates another exploded view of the example in FIG. 4.

FIG. 7 illustrates another exploded view of the example in FIG. 4.

FIG. 7 shows another view of this example, which further shows the first wiring groove 521 and the second wiring groove 522 on the rotation wheel 520.

Figure 8:
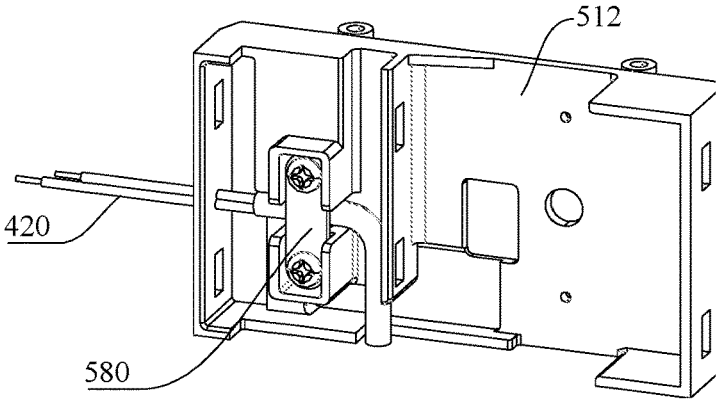
FIG. 8 illustrates a wire fastener example.

FIG. 8 illustrates a wire fastener example.

FIG. 9 illustrates a cross-sectional view of the example in FIG. 1.

In FIG. 9, the light module 300 is fixed in a light module housing 310 with a buckle structure 320 to buckle to a corresponding buckle 680 of the downlight housing 100.

The drawstring module has a first guiding block 612, an elastic module 660, an elastic positioning unit 670, a second container groove 615, a tilt sliding groove 613, a fixing station 611, a through hole 626, a protruding part 625, a pressing block 622, and a limiting unit 623.

Figure 10:
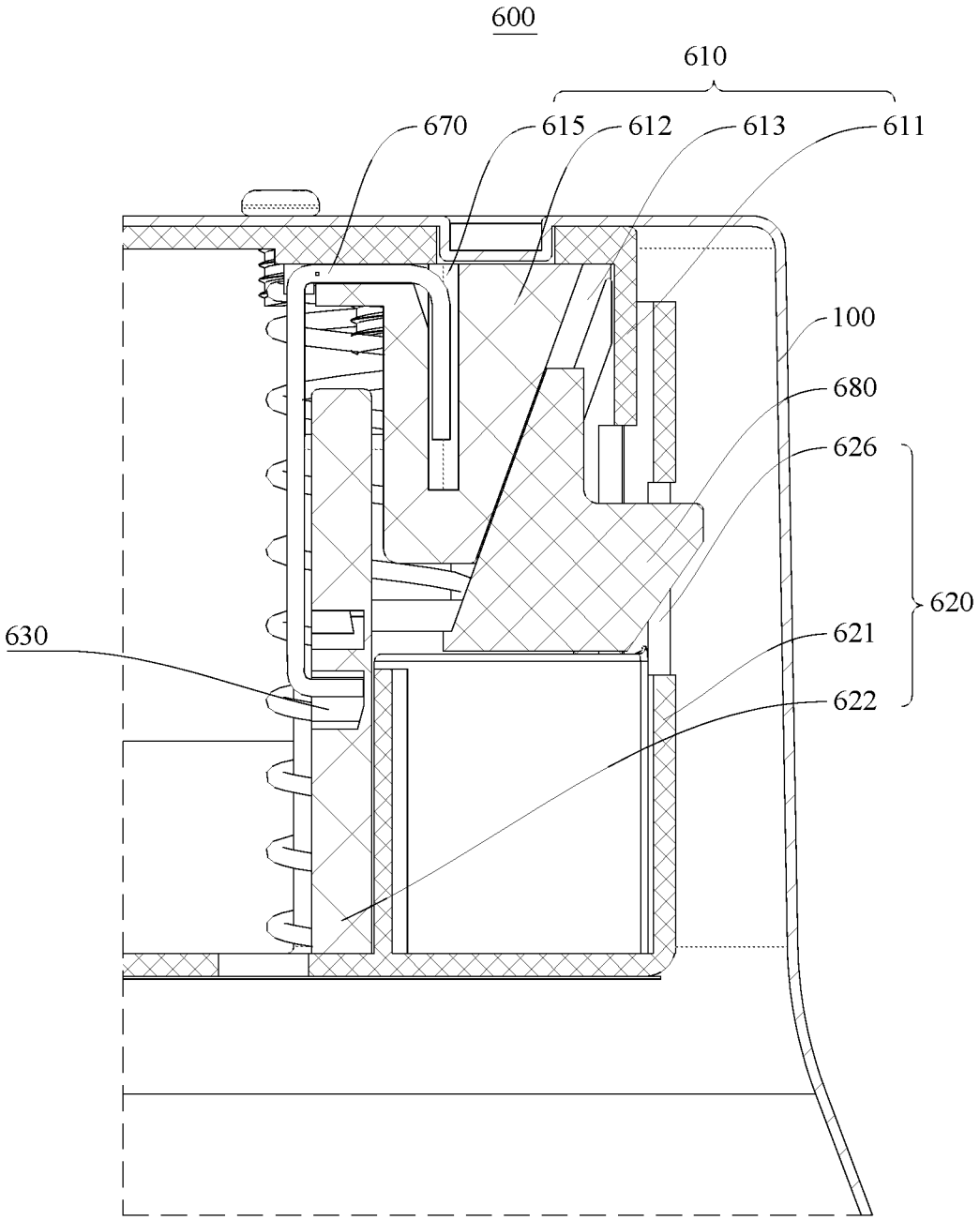
FIG. 10 illustrates a cross-sectional zoom-up view of a connecting parts of an example.

FIG. 10 illustrates a cross-sectional zoom-up view of a connecting parts of an example.

FIG. 11 illustrates a component example in a drawstring module.

The elastic positioning module 670 has a first bending groove 6321, a second bending groove 632, a positioning unit 530, a sliding groove 633, and an anti-moving-back part 650 for keeping the pullable wire to stay at current position if no external pulling force is applied.

Figure 12:
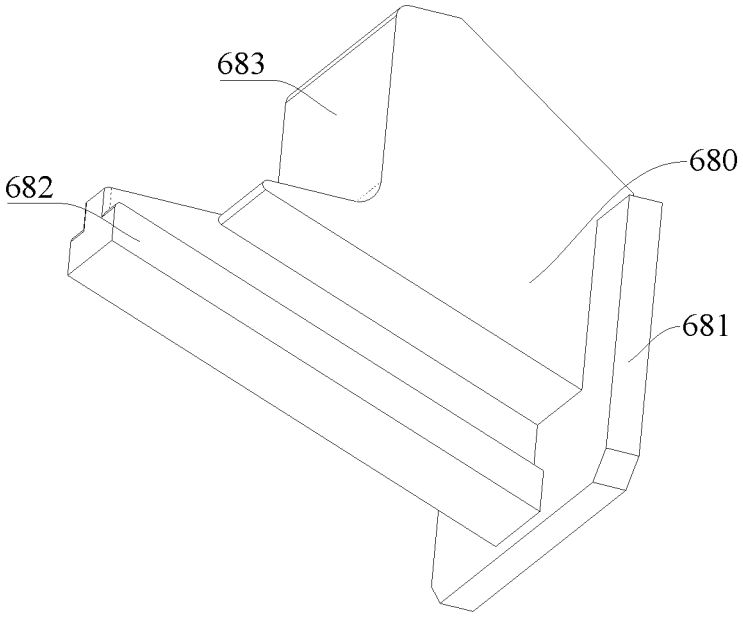
FIG. 12 illustrates another component example in a drawstring module.

FIG. 12 illustrates another component example in a drawstring module.

The buckle 680 has a first sliding part 681, a buckle connector 683 and a second sliding part 682.

Figure 13:
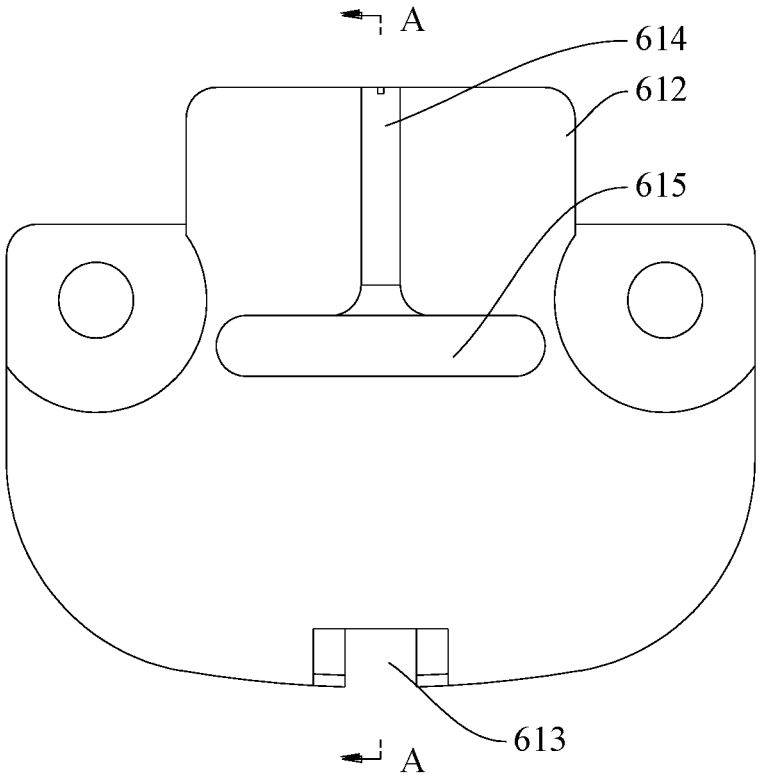
FIG. 13 illustrates another component example in a drawstring module.

FIG. 13 illustrates another component example in a drawstring module.

The first container groove 614, the first guiding block 612 and the second container groove 615 are used together with the tilt sliding groove 613 for the pullable wire to move.

Figure 14:
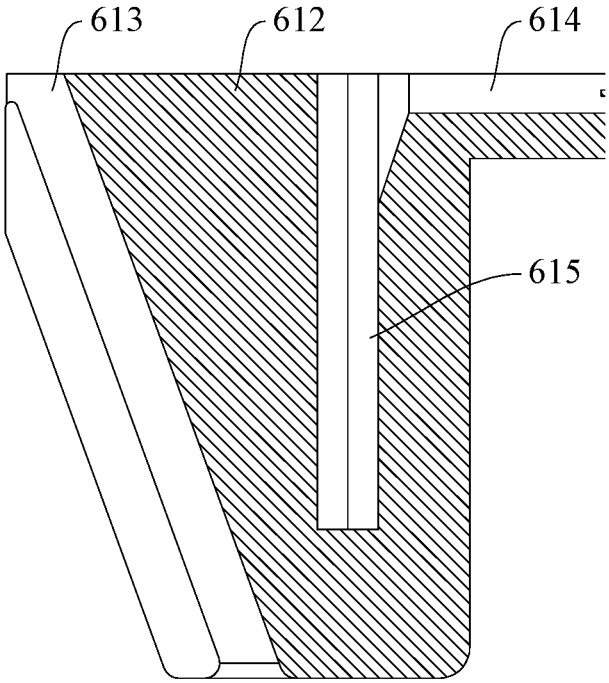
FIG. 14 illustrates another component example in a drawstring module.

FIG. 14 illustrates another component example in a drawstring module. Another angle of view of the example in FIG. 12 is illustrated.

FIG. 15 illustrates a stop unit example. The elastic positioning unit 670 has an anti-moving-back unit 671.

Figure 16:
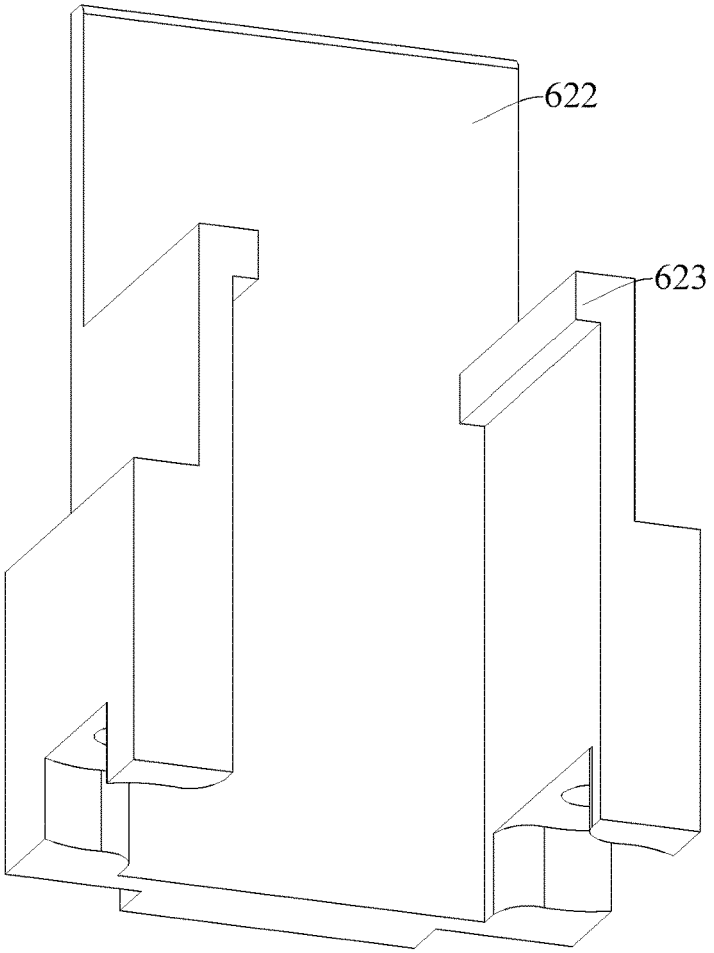
FIG. 16 illustrates another component example in a drawstring module.

FIG. 16 illustrates another component example in a drawstring module.

The fastening block 622 is used together with the limiting part 623 for holding the wiring bracket.

Figure 17:
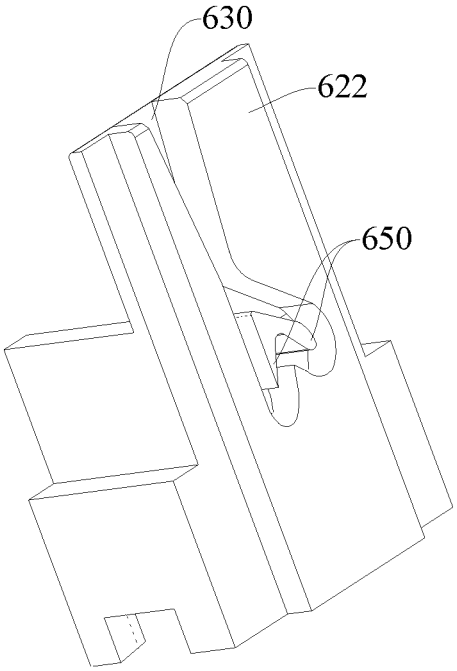
FIG. 17 illustrates another component example in a drawstring module.

FIG. 17 illustrates another component example in a drawstring module.

The anti-moving-back-unit 650 is used together with the fastening block 622 and the limiting part 630.

Figure 18:
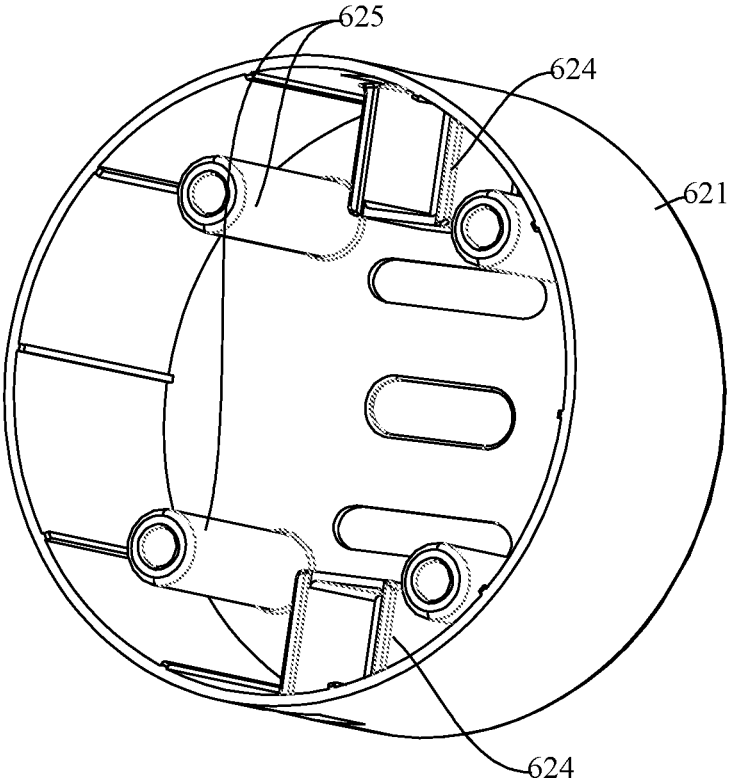
FIG. 18 illustrates a string box part example.

FIG. 18 illustrates a string box part example that has a protruding part 624, a lifting cover 621 and a second plugging unit 625.

Figure 19:
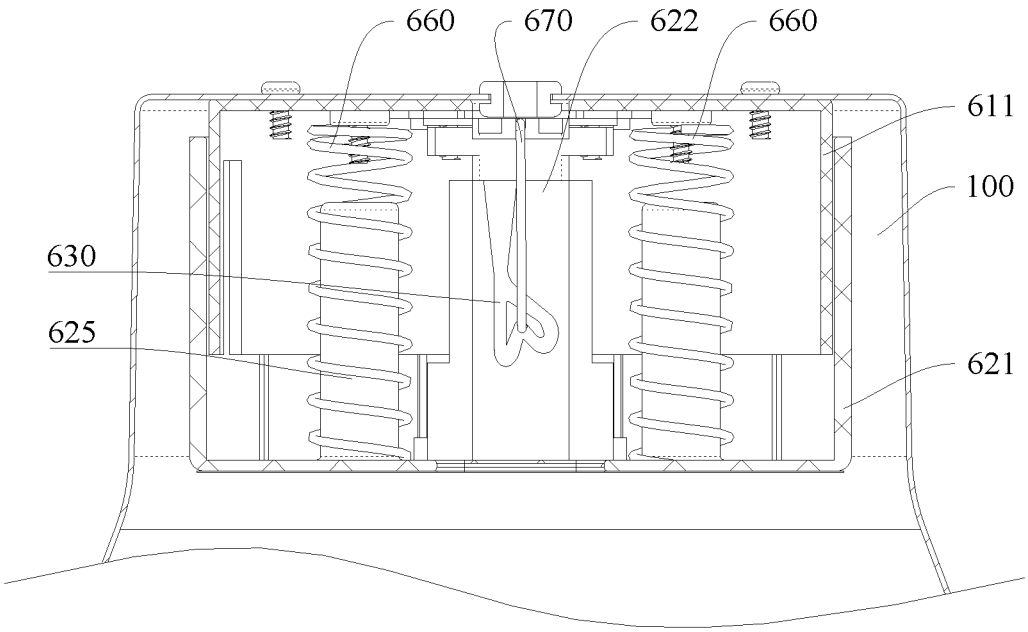
FIG. 19 illustrates a cross-sectional view of a drawstring module.

FIG. 19 illustrates a cross-sectional view of a drawstring module showing the components mentioned above.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A downlight apparatus, comprising:

a downlight housing with a surface rim and a downlight holder, wherein the surface rim defines a rim opening, wherein the surface rim conceals an installation cavity, wherein the downlight holder defines a holder space connected to the rim opening, wherein the downlight housing is attached in the installation cavity with a fixing unit;

a drawstring module for collecting a pullable wire, wherein the pullable wire is electrically connected to a power source; and a light module with a light source and a light housing, wherein the light housing is connected to a bottom end of the pullable wire for electrically connecting the power source to the light source, wherein the light module is pulled out from the holder space to an adjustable distance from the rim opening with the pullable wire connecting the light module to the downlight housing, wherein the drawstring module has a string box and a wiring bracket, wherein the wiring bracket has a rotation wheel for collecting the pullable wire, wherein the wiring bracket has an elastic module for providing an elastic force for pulling the pullable wire back to the rotation wheel, wherein the wiring bracket has a stop unit for keep the pullable wire to stay when no external pulling force is applied to the pullable wire, wherein the wiring bracket comprises a tilt sliding groove for guiding detaching the pullable wire from the stop unit temporarily.

2. The downlight apparatus of claim 1, wherein the fixing unit comprises a pair of elastic units for elastically changing a span diameter to fix the downlight housing to the installation cavity.

3. The downlight apparatus of claim 1, further comprising a driver box with a driver circuit for converting an external power to the power source supplied to the pullable wire.

4. The downlight apparatus of claim 1, wherein the stop unit has an elastic module with a bent part for guiding the pullable wire to detach from the stop unit when an external pulling force is applied to the pullable wire and guiding the pullable wire to engage the stop unit when no external pulling force is applied to the pullable wire.

5. The downlight apparatus of claim 1, wherein the drawstring module has a wire fastener for fixing a wire part of the pullable wire nonmovable with respect to the string box.

6. The downlight apparatus of claim 1, wherein a wire connector is used for electrically connecting a power wire to the pullable wire.

7. The downlight apparatus of claim 1, wherein the light module has a light module connector connecting to the pullable wire, wherein the light module connector is detachable from the pullable wire to replace another light module to attach to the pullable wire.

8. The downlight apparatus of claim 1, wherein the light module has a rotation bracket for changing a light direction of the light source.

9. The downlight apparatus of claim 1, wherein the light module has a manual switch to turn on or turn off the light source.

10. The downlight apparatus of claim 1, wherein the light module has a manual switch for adjusting a light parameter of the light source.

11. The downlight apparatus of claim 10, wherein the light source has multiple types of LED modules to mix a required color temperature, wherein the manual switch indicates the required color temperature.

12. The downlight apparatus of claim 1, wherein the light module has a sensor for detecting an ambient light parameter around a current position of the light module, wherein the light source is automatically adjusted according to the ambient light parameter.

13. The downlight apparatus of claim 1, wherein the drawstring module has a motor for extending or collecting the pullable wire to change a relative distance of the light module to the downlight housing.

14. The downlight apparatus of claim 13, wherein the light module has a detector for sensing a user operation to actuate the motor to change the relative distance of the light module and the downlight housing.

15. The downlight apparatus of claim 14, wherein the detector detects a user gesture to actuate the motor to move the pullable string.

16. The downlight apparatus of claim 1, wherein the light source has a lateral light source and a bottom light source to be controlled separately.

17. The downlight apparatus of claim 1, wherein the light source has a light source electrode to be detachable from the light housing to be replaced with another light source.

* * * * *